US006447360B1

(12) United States Patent
Sorensen

(10) Patent No.: US 6,447,360 B1
(45) Date of Patent: Sep. 10, 2002

(54) INTERCONNECTION OF TOY BUILDING ELEMENTS IN A RELEASABLE RESTRAINING ENGAGEMENT

(76) Inventor: Soren Christian Sorensen, P.O. Box 256, North Side, Grand Cayman (KY)

( * ) Notice: Subject to any disclaimer, the term of this patent is extended or adjusted under 35 U.S.C. 154(b) by 0 days.

(21) Appl. No.: 09/559,249

(22) Filed: Apr. 26, 2000

(51) Int. Cl.[7] ..... A63H 33/08

(52) U.S. Cl. ..... 446/124; 446/125; 446/127; 446/120; 446/117

(58) Field of Search ..... 446/127, 125, 446/124, 128, 117, 120, 121; 52/590.1, 590.6, 590.5, 590.3, DIG. 10

(56) References Cited

U.S. PATENT DOCUMENTS

| | | | | |
|---|---|---|---|---|
| 2,132,757 A | | 10/1938 | Paulson | |
| 3,195,266 A | | 7/1965 | Onanian | |
| 3,374,917 A | | 3/1968 | Troy | |
| 4,964,833 A | * | 10/1990 | Suzuki | 446/125 |
| 5,653,621 A | | 8/1997 | Yao | |
| 5,795,210 A | | 8/1998 | Kushner et al. | |
| 5,826,394 A | | 10/1998 | Barton, Jr. et al. | |
| 5,853,314 A | * | 12/1998 | Bora | 446/125 |
| 6,059,631 A | * | 5/2000 | Maddock | 446/127 |
| 6,102,766 A | * | 8/2000 | Leadbetter et al. | 446/128 |

FOREIGN PATENT DOCUMENTS

| | | |
|---|---|---|
| EP | 0 766 585 | 3/1993 |
| WO | WO 98/35735 | 8/1998 |

* cited by examiner

*Primary Examiner*—Derris H. Banks
*Assistant Examiner*—Urszula M Cegielnik
(74) *Attorney, Agent, or Firm*—Edward W. Callan

(57) ABSTRACT

A building element for a set of toy building elements that are capable of being interconnected in a releasable engagement includes side walls having grooves and tongues, a top having a broad surface that extends toward the side walls and a primarily cylindrical projection extending above the broad surface; a open bottom; and an interior having a plurality of ribs with contact surfaces that are accessible through the open bottom and disposed for interconnecting with the projection on the top of another such building element. At least some of the contact surfaces of the interior ribs include lateral indentations; and the projection includes a circular lateral ridge disposed above the broad surface for being interconnected in a releasable restaining engagement within the indentations in the interior contact surfaces of the ribs of another such building element. The tongues in the side walls are adapted for interconnecting in a releasable restraining engagement within a groove in a side wall of another such building element.

12 Claims, 1 Drawing Sheet

FIG. 1
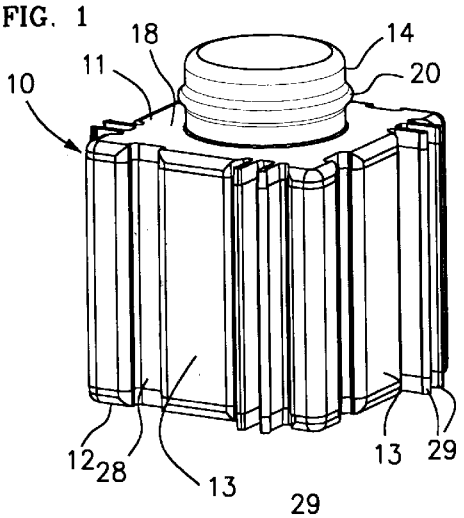
FIG. 2
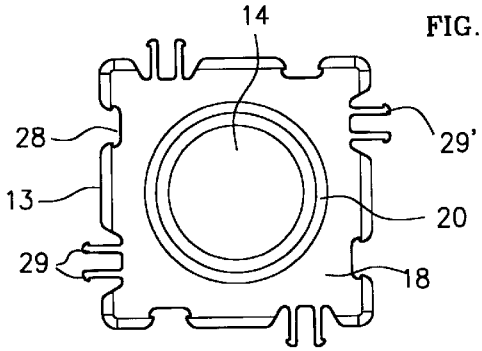
FIG. 5
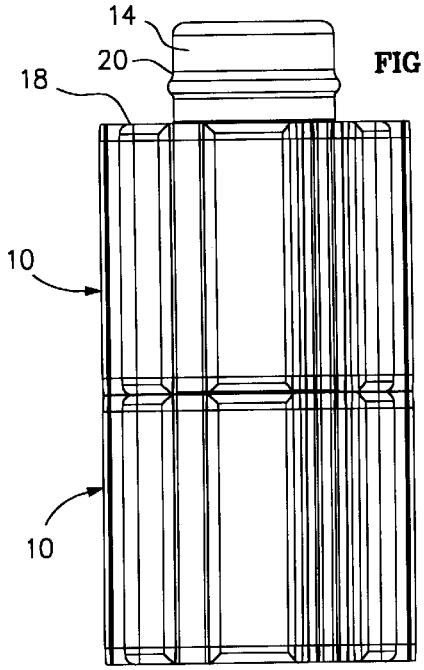
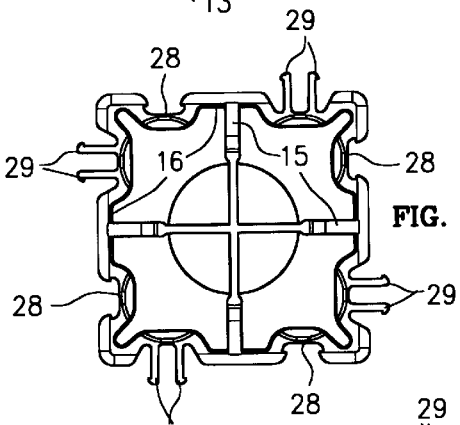
FIG. 3
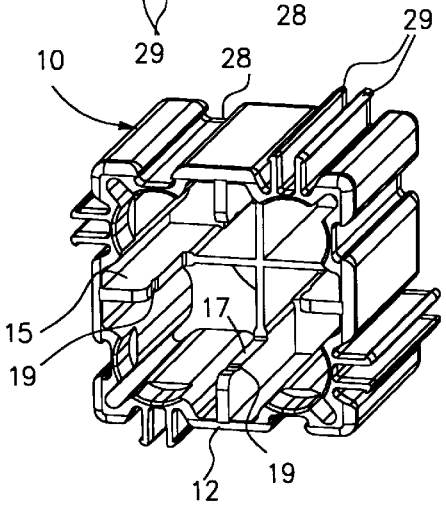
FIG. 4
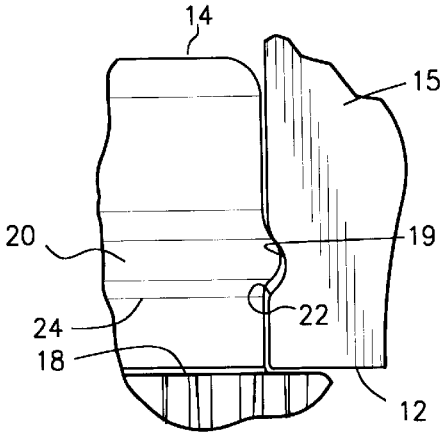
FIG. 6
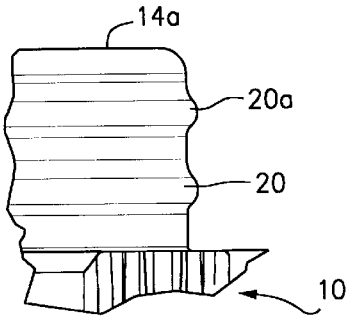
FIG. 7

INTERCONNECTION OF TOY BUILDING ELEMENTS IN A RELEASABLE RESTRAINING ENGAGEMENT

BACKGROUND OF THE INVENTION

The present invention generally pertains to assembly toys and is particularly directed to an improved building element for a set of toy building elements.

Examples of prior art toy building elements are described in European Patent No. 0,766,585 and in U.S. Pat. Nos. 2,132,757; 3,195,266; 3,374,917; 5,653,621; 5795.210 and 5,826,394. The toy building element described in European Patent No. 0,766,585 includes side walls; a top having a broad surface that extends toward the side walls and a cylindrical projection extending above the broad surface; a open bottom; and an interior having a plurality of surfaces that are accessible through the open bottom and disposed for interconnecting with the projection on the top of another such building element in a releasable frictional engagement; wherein two of the side walls each includes a groove; and two of side walls each includes a tongue for interconnecting in a releasable restraining engagement within a groove in a side wall of another such building element.

SUMMARY OF THE INVENTION

In one aspect, the present invention provides a building element for a set of toy building elements that are capable of being interconnected in a releasable engagement, comprising side walls; a top having a broad surface that extends toward the side walls and a projection extending above the broad surface; an open bottom; and an interior having a plurality of ribs extending inwardly from the sidewalls, with said ribs including contact surfaces that are accessible through the open bottom and disposed for interconnecting with the projection on the top of another such building element in a releasable engagement; wherein at least some of the interior contact surfaces include lateral indentations; and wherein the projection includes at least one lateral ridge disposed above the broad surface for being interconnected in a releasable restraining engagement within at least some of the indentations in the interior contact surfaces of another such building element.

In another aspect, the present invention provides a building element for a set of toy building elements that are capable of being interconnected in a releasable engagement, comprising side walls; a top having a broad surface that extends toward the side walls and a projection extending above the broad surface; an open bottom; and an interior having a plurality of ribs extending inwardly from the sidewalls, with said ribs including contact surfaces that are accessible through the open bottom and disposed for interconnecting with the projection on the top of another such building element in a releasable engagement; wherein the projection and at least some of the interior contact surfaces are adapted for effecting a releasable restraining engagement between the projection of said building element and said at least some of the interior contact surfaces of another such building element; wherein at least one of the side walls includes at least one groove; wherein at least one of the side walls includes at least one tongue for interconnecting in a reasonable restraining engagement within a said groove in a side wall of another said building element; wherein in at least some of the interior contact surfaces include lateral indentations; and wherein the projection includes at least one lateral ridge disposed above the broad surface for being interconnected in a releasable restraining engagement within at least some of the indentions in the interior contact surfaces of another such building element.

In further aspect, the present invention provides a building element for a set of toy building elements that are capable of being interconnected in a releasable engagement, comprising side walls; a top having a broad surface that extends toward the side walls and a projection extending above the broad surface; an open bottom; and an interior having a plurality of contact surfaces that are accessible through the open bottom and disposed for interconnecting with the projection on the top of another such building element in a releasable engagement; wherein at least some of the interior contact surfaces include lateral indentations; wherein the projection includes at least one lateral ridge disposed above the broad surface for being interconnected in a releasable restraining engagement within at least some of the indentations in the interior contact surfaces of another such building element; wherein at least some of the indentations are disposed a given distance above the bottom; wherein the at least one ridge is disposed approximately the given distance above the broad surface for said releasable restraining engagement within said at least some of the indentations in the interior contact surfaces of another such building element when the broad surface contacts the bottom of said another such building element; and wherein the beginning of the at least some indentations above the bottom is less distance above the bottom than the distance of the beginning of the ridge above the broad surface.

Additional features of the present invention are described with reference to the detailed description of the preferred embodiments.

BRIEF DESCRIPTION OF THE DRAWING

FIG. 1 is a top and two-sided perspective view of a preferred embodiment of a building element according to the present invention.

FIG. 2 is a top view of the building element of FIG. 1.

FIG. 3 is a bottom view of the building element of FIG. 1.

FIG. 4 is an enlarged bottom perspective view of the building element of FIG. 1.

FIG. 5 is a side view of a set of building elements, wherein two building elements according to FIG. 1 are interconnected top-to-bottom.

FIG. 6 is an enlarged cutaway side view illustrating a releasable restraining engagement of the projection on the top of a building element according to FIG. 1 within an indentation in an interior rib of another building element according to FIG. 1.

FIG. 7 is an enlarged side view of an alternative embodiment of the projection on the top of the building element of FIG. 1.

DETAILED DESCRIPTION

Referring to FIGS. 1 through 6, a preferred embodiment of a building element 10 according to the present invention includes a top 11, a bottom 12 and four side walls 13. The top 11 of the building element 10 includes a primarily cylindrical projection 14 and the bottom 12 of the building element 10 is open. The four side walls 13 define a square.

The interior surfaces of the building element 10 include ribs 15 that are accessible through the open bottom 12 of the building element 10. The ribs 15 extend inwardly at a right angle from the center of each interior side wall 16 and include contact surfaces 17 that are disposed for interconnecting with the projection 14 on the top 11 of another such building element 10 in a releasable engagement.

The top 11 of the building element 10 has a broad surface 18 that extends toward the side walls 13; and the projection 14 extends above the broad surface 18.

At least some of the contact surfaces 17 of the ribs 15 include indentations 19; and the projection 14 includes a circular ridge 20 disposed above the broad surface 18 for a releasable restraining engagement within at least some of the indentations 19 in the contact surfaces 17 of the ribs 15 of another such building element 10. The depth of the indentations 19 and the extension of the ridge 20 from the projection 14 are considerably exaggerated in the drawing to better illustrate the indentations 19 and the ridge 20. At least some of the indentations 19 are disposed a given distance above the bottom; and the ridge 20 is disposed approximately the given distance above the broad surface 18 for such releasable restraining engagement within the indentations 19 in the contact surfaces 17 of the ribs 15 of the other such building element 10 when the broad surface 18 contacts the bottom 12 of the other such building element 10, as shown in FIGS. 5 and 6.

Preferably, the beginning 22 of the indentation 19 above the bottom 12 is less distance above the bottom 12 than the distance of the beginning 24 of the ridge 20 above the broad surface 18, as shown in FIG. 6. This configuration enhances the releasable restraining engagement established when the ridge 20 of one building element 10 is engaged with the indentations 19 in the contact surfaces 17 of the interior ribs 15 of another building element 10, and also provides an enhanced clicking sound when the broad top surface 18 of the one building element 10 contacts the bottom 12 of the other building element 10, to thereby confirm the establishment of such releasable restraining engagement. Preferably, the diameter of the projection 14 at the ridge 20 is slightly less than the distance between opposing indentations 19.

In an alternative embodiment of the projection 14*a* on the top 11 of the building element, as shown in FIG. 7, an additional ridge 20*a* is disposed above the broad surface 18 by more than the given distance at which the indentations 19 are disposed above the bottom 12. This configuration enables a releasable restraining engagement of the ridge 20*a* of one building element 10 within the indentations 19 in the contact surfaces 17 of the interior ribs 15 of another such building element 10 when the broad surface 18 of the one building element 10 does not contact the bottom 12 of the other such building element 10. In other alternative embodiments (not shown), there are multiple indentations 19 disposed in each interior rib 15 at a plurality of different distances above the bottom 12 to receive both ridges 20, 20*a* of another building element having a projection 14*a* according to FIG. 7, or the one ridge 20 of another building element 10 according to FIGS. 1–6 at any of the different distances above the bottom 12.

Referring again to FIGS. 1 to 3, each of the side walls 13 includes one groove 28 and one tongue 29 that are dimensioned for enabling a tongue 29 on one building element 10 to reside in a groove 28 in another such building element 10 in a releasable restraining engagement. Each groove 28 has an entry opening of a given predominant and a base region 20 of a greater width. The predominant width of the entry the entry 20 is the minimum width of the groove 28 that predominates over the length of the groove 28 between the top 11 and the bottom 12 of the building element 10.

The tongue 29 is flexible and split longitudinally into two parallel sections 29', which can be compressed laterally in order to effect the restraining engagement in the groove 28 by frontally pressing the tongue 29 into the groove 28 in another building element 10. The tongue 29 can be disengaged from the groove 28 in another such building element 10 by frontally pulling the building element 10 from the other said building element 10 or by twisting the building element 10 from the other building element 10. The tongue 29 can also be engaged with or disengaged from the groove 28 in the other such building element 10 by sliding the tongue 29 into or from one end of the groove 28 in the other building element 10.

Additional preferred features of the grooves 28 and tongues 29 are described in U.S. patent application Ser. No. 09/246,317 filed Feb. 8, 1999 and in International Patent Application No. PCT/EP00/00760 filed Feb. 1, 2000, the pertinent portions of which are incorporated herein by reference thereto.

In alternative embodiments (not shown), (a) the lateral cross-sectional shape of the block defined by the side walls may be other than square, such as octagonal as shown in U.S. Design patent application Ser. No. 29/112,775 filed Oct. 22, 1999, an elongated rectangle, circular, semi- or quarter-circular or triangular, for example; (b) the tongues in the side walls are solid rather than split; (c) coupling means other than described herein, such as those of the prior art, are included for interconnecting a side wall of one building element to a side wall of another building element in a releasable engagement; (d) the side walls do not include any means for interconnecting the building elements side-to-side; (e) the projection from the top of the building element is other than primarily cylindrical; (f) the ridge on the projection is other than circular; (g) there are indentations in the interior ribs of the building element at different distances above the bottom of the building element; (h) not all of the interior ribs that are for engaging the projection of another building element include indentations; and (i) the building elements have different side-wall width-to-height aspect ratios than illustrated herein.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

I claim:

1. A building element for a set of toy building elements that are capable of being interconnected in a releasable engagement, comprising side walls;

a top having a broad surface that extends toward the side walls and a projection extending above the broad surface;

an open bottom; and an interior having a plurality of ribs extending inwardly from the sidewalls, with said ribs including contact surfaces that are accessible through the open bottom and disposed for interconnecting with the projection on the top of another such building element in a releasable engagement;

wherein at least some of the interior contact surfaces include lateral indentations, and wherein the projection includes at least one lateral ridge disposed above the broad surface for being interconnected in a releasable restraining engagement within at least some of the indentations in the interior contact surfaces of another such building element.

2. A building element according to claim 1, wherein at least some of the indentations are disposed a given distance above the bottom; and wherein the at least one ridge is disposed approximately th given distance above the broad surface for said releasable restraining engagement within said at least some of the indentations in the interior contact surfaces of another such building element when the broad surface contacts the bottom of said another such building element.

3. A building element according to claim 2, wherein the beginning of the at least some indentions above the bottom is less distance above the bottom than distance of the beginning of the ridge above the broad surface.

4. A building element according to claim 2, wherein at least one additional lateral ridge is disposed more than the given distance above the broad surface for said releasable restraining engagement within said at least some of the indentations in the interior contact surfaces of another such building element when the broad surface does not contact the bottom of said another such building element.

5. A building element according to claim 1, wherein the projection is primarily cylindrical and the at least one ridge is circular.

6. A building element according to claim 5, wherein at least some of the indentations are disposed a given distance above the bottom; and wherein the at least one ridge is disposed approximately the given distance above the broad surface for said releasable restraining engagement within said at least some of the indentations in the interior contact surfaces of another such building element when the broad surface contacts the bottom of said another such building element.

7. A building element according to claim 5, wherein the beginning of at least some indentations above the bottom is less distance above the bottom than the distance of the beginning of the ridge above the broad surface.

8. A building element according to claim 1, wherein at least one of the side walls includes at least one groove; and wherein at least one of the side walls includes at least one tongue for interconnecting in a reasonable restraining engagement within a said groove in a side wall of another said building element.

9. A building element for a set of toy building elements that are capable of being interconnected in a releasable engagement, comprising side walls;

a top having a broad surface that extends toward the side walls and a projection extending above the broad surface;

an open bottom; and an interior having a plurality of ribs extending inwardly from the sidewalls, with sad ribs including contact surfaces that are accessible through the open bottom and disposed for interconnecting with the projection on the top of another such building element in a releasable engagement;

wherein the projection and at least some of the interior contact surfaces are adapted for effecting a releasable restraining engagement between the projection of said building element and said at least some of the interior contact surfaces of another such building element;

wherein at least one of the side walls includes at least one groove;

wherein at least one of the side walls includes at least one tongue for interconnecting in a releasable restraining engagement within a said groove in a side wall of another said building element;

wherein at least some of the interior contact surfaces include lateral indentations; and wherein the projection includes at least one lateral ridge disposed above the broad surface for being interconnected in a releasable restraining engagement within at least some of the indentations in the interior contact surfaces of another such building element.

10. A building element according to claim 9, wherein at least some of the indentations are disposed a given distance above the bottom; and wherein the at least one ridge is disposed approximately the given distance above the broad surface for said releasable restraining engagement within said at least some of the indentations in the interior contact surfaces of the other such building element when the broad surface contacts the bottom of the other such building element.

11. A building element according to claim 10, wherein the beginning of the at least some indentations above the bottom is less distance above the bottom than the distance of the beginning of the ridge above the broad surface.

12. A building element for set of toy building elements are capable of being interconnected in a reasonable engagement, comprising side walls;

a top having a broad surface that extends toward the side walls and a projection extending above the broad surface;

an open bottom; and an interior having a plurality of contact surfaces that are accessible through the open bottom and disposed for interconnecting with the projection on the top of another such building element in a releasable engagement;

wherein at least some of the interior contact surfaces include lateral indentations;

wherein the projection includes at least one lateral ridge disposed above the broad surface for being interconnected in a reasonable restaining engagement within at least some of the indentations in the interior contact surfaces of another such building element;

wherein at least some of the indentations are disposed a given distance above the bottom;

wherein the at least one ridge is disposed approximately the given distance above the broad surface for said releasable restraining engagement within said at least some of the indentations in the interior contact surfaces of another such building element when the broad surface contacts the bottom of said another such building element; and wherein the beginning of the at least some indentations above the bottom is less distance above the bottom than the distance of the beginning of the ridge above the broad surface.

* * * * *

UNITED STATES PATENT AND TRADEMARK OFFICE

CERTIFICATE OF CORRECTION

PATENT NO. : 6,447,360 B1
DATED : September 10, 2002
INVENTOR(S) : Soren Christian Sorensen It is certified that error appears in the above-identified patent and that said Letters Patent is hereby corrected as shown below:

Column 3,
Line 61, after “predominant”, insert -- width --.
Line 62, after “entry”, insert -- opening --.
Line 62, delete “the” (third occurrence).
Line 63, delete “entry”.

Column 5,
Line 10, “th”, should read -- the --.
Line 18, after “than”, insert -- the --.
Line 60, “sad”, should read -- said --.

Column 6,
Line 31, after “for”, insert -- a --.
Line 31, after “elements”, insert -- that --.
Line 32, “reasonable”, should read -- releasable --.
Line 49, “reasonable”, should read -- releasable --.
Line 49, “restaining”, should read -- restraining --.

Signed and Sealed this

Fourth Day of March, 2003

JAMES E. ROGAN
*Director of the United States Patent and Trademark Office*